US008858372B1

(12) United States Patent
Trieu

(10) Patent No.: US 8,858,372 B1
(45) Date of Patent: Oct. 14, 2014

(54) TABLE TENNIS SKILL IMPROVEMENT RACKET

(71) Applicant: Alan Trieu, Fontana, CA (US)

(72) Inventor: Alan Trieu, Fontana, CA (US)

( * ) Notice: Subject to any disclaimer, the term of this patent is extended or adjusted under 35 U.S.C. 154(b) by 0 days.

(21) Appl. No.: 14/156,116

(22) Filed: Jan. 15, 2014

Related U.S. Application Data

(63) Continuation-in-part of application No. 13/545,661, filed on Jul. 10, 2012, now Pat. No. 8,663,036.

(51) Int. Cl.
*A63B 59/04* (2006.01)
*A63B 67/04* (2006.01)

(52) U.S. Cl.
CPC ..... *A63B 59/04* (2013.01); *A63B 67/04* (2013.01)
USPC ..... 473/527

(58) Field of Classification Search
USPC ..... 473/524, 527; D21/731, 732, 729
See application file for complete search history.

(56) References Cited

U.S. PATENT DOCUMENTS

| | | | | |
|---|---|---|---|---|
| 2,161,463 | A | 6/1939 | Frost | |
| 2,174,884 | A | 10/1939 | Kachel | |
| 2,208,086 | A * | 7/1940 | Singer | 273/330 |
| 2,313,701 | A | 3/1943 | White | |
| 3,088,735 | A | 5/1963 | Clark | |
| 3,954,266 | A * | 5/1976 | Carrano et al. | 273/348.2 |
| 4,134,585 | A | 1/1979 | Semon | |
| D260,154 | S | 8/1981 | Dremel | |
| 4,676,511 | A | 6/1987 | Mackie | |
| 4,772,018 | A | 9/1988 | Inniger | |
| 4,943,056 | A | 7/1990 | Bowers | |
| 5,178,385 | A | 1/1993 | Barbador | |
| 5,470,057 | A | 11/1995 | Bodford, Jr. | |
| 5,566,936 | A | 10/1996 | Newgarden et al. | |
| 5,575,471 | A | 11/1996 | Robinson | |
| 5,655,979 | A | 8/1997 | Blue | |
| 5,935,024 | A | 8/1999 | Lao | |
| 6,729,982 | B1 | 5/2004 | Appelbaum et al. | |
| 8,079,922 | B1 | 12/2011 | Paterson | |
| 8,216,094 | B2 | 7/2012 | Seme | |
| 2008/0167145 | A1 * | 7/2008 | Madzuma | 473/527 |
| 2012/0010031 | A1 * | 1/2012 | Reisman et al. | 473/527 |

* cited by examiner

*Primary Examiner* — Raleigh W Chiu

(57) ABSTRACT

A skill improvement racket for use when playing a game of Table Tennis features a linear handle. The racket features a planar, circular blade having a blade first side with a blade first side area. The blade features a blade upper edge, an opposing blade lower edge, a blade first edge, an opposing blade second edge, and a blade midline axis. The blade lower edge is located on a handle first end. The racket features a first color circle with a first color circle area. The first color circle is located on the blade first side adjacent to the blade first edge and proximal to the blade upper edge. The first color circle is a contrasting color with respect to a blade first side color located on the blade first side.

12 Claims, 5 Drawing Sheets

TABLE TENNIS SKILL IMPROVEMENT RACKET

CROSS REFERENCE

This application claims priority to U.S. patent application Ser. No. 13/545,661, filed Jul. 10, 2012, the specification(s) of which is/are incorporated herein in their entirety by reference.

FIELD OF THE INVENTION

The present invention relates to Table Tennis or Ping-Pang rackets or paddles.

BACKGROUND OF THE INVENTION

Table tennis is believed to have originated in England during the 1800s and is often referred to by the copyrighted name, Ping-Pong®. Typically two or four players are positioned at opposite ends of a table having a net affixed at a midpoint of the table between the players. A ball is struck by a paddle back and forth over the net by the players until points are scored. The present invention features a skill improvement racket for use when playing a game of Table Tennis highlighting a preferred zone of a Table Tennis racket via a first color circle for striking a Table Tennis ball.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a skill improvement racket for use when playing a game of Table Tennis highlighting a preferred zone of a Table Tennis racket via a first color circle for striking a Table Tennis ball. In some embodiments, the racket comprises a linear handle.

In some embodiments, the racket comprises a planar, circular blade having a blade first side with a blade first side area. In some embodiments, the blade comprises a blade upper edge, an opposing blade lower edge, a blade first edge, an opposing blade second edge, and a blade midline axis. In some embodiments, the blade lower edge is disposed on a handle first end.

In some embodiments, the racket comprises a first color circle comprising a first color circle area. In some embodiments, the first color circle is disposed on the blade first side adjacent to the blade first edge and proximal to the blade upper edge. In some embodiments, the first color circle is a contrasting color with respect to a blade first side color disposed on the blade first side.

DESCRIPTION OF PREFERRED EMBODIMENTS

Figure 1:
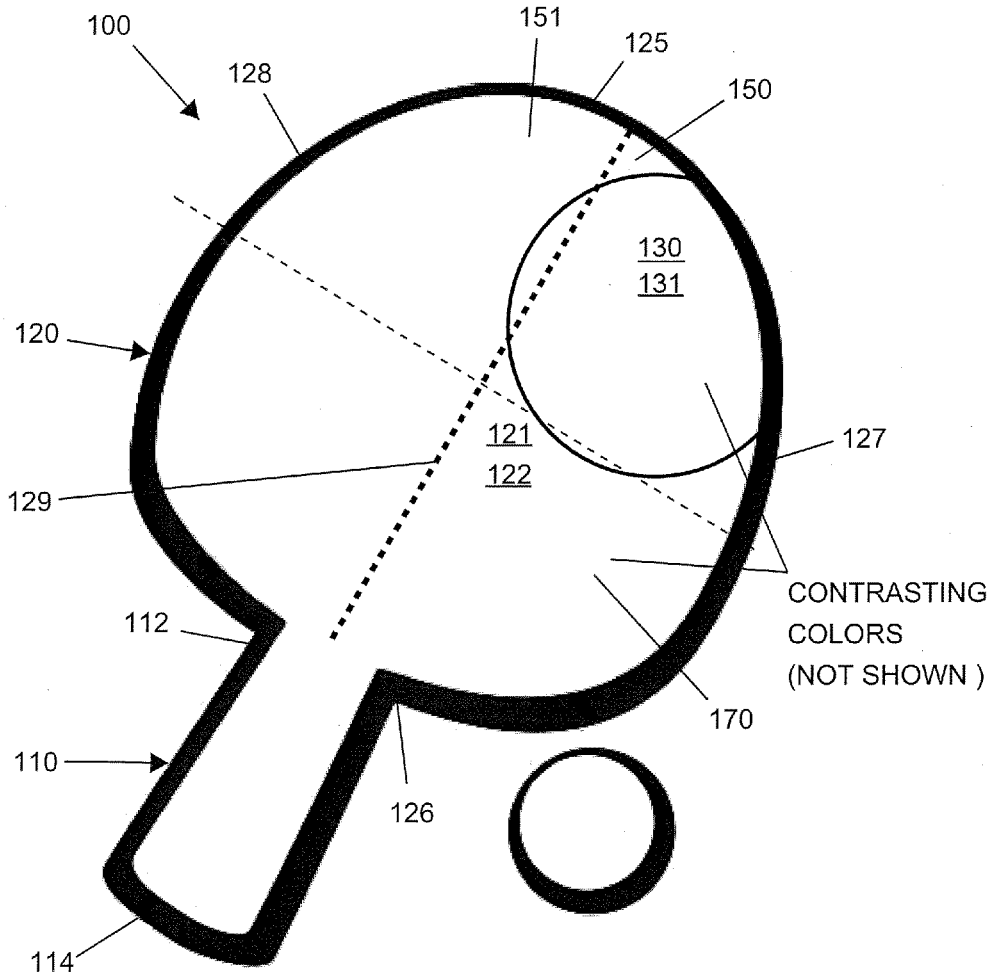
FIG. 1 shows a perspective view of the blade first side of the present invention.
Figure 2:
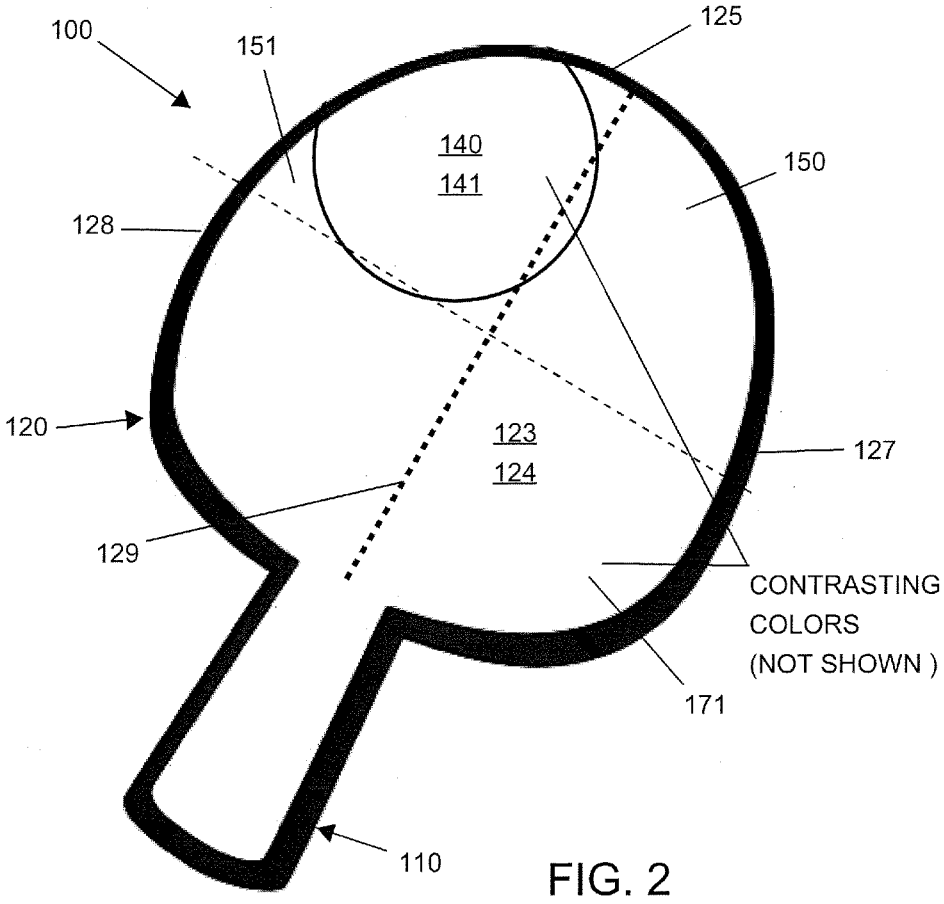
FIG. 2 shows a perspective view of the blade second side of the present invention.
Figure 3:
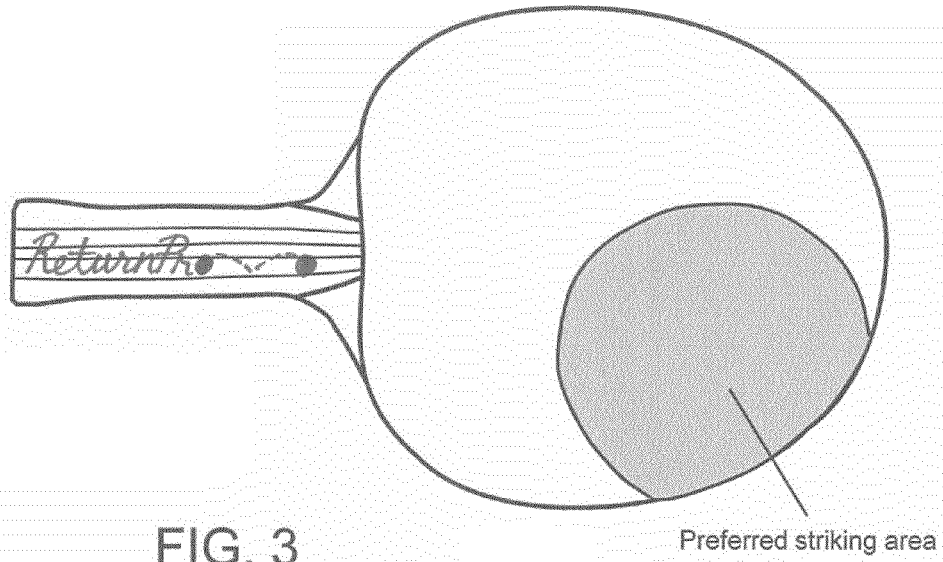
FIG. 3 shows a top view of the blade first side of the present invention.
Figure 4:
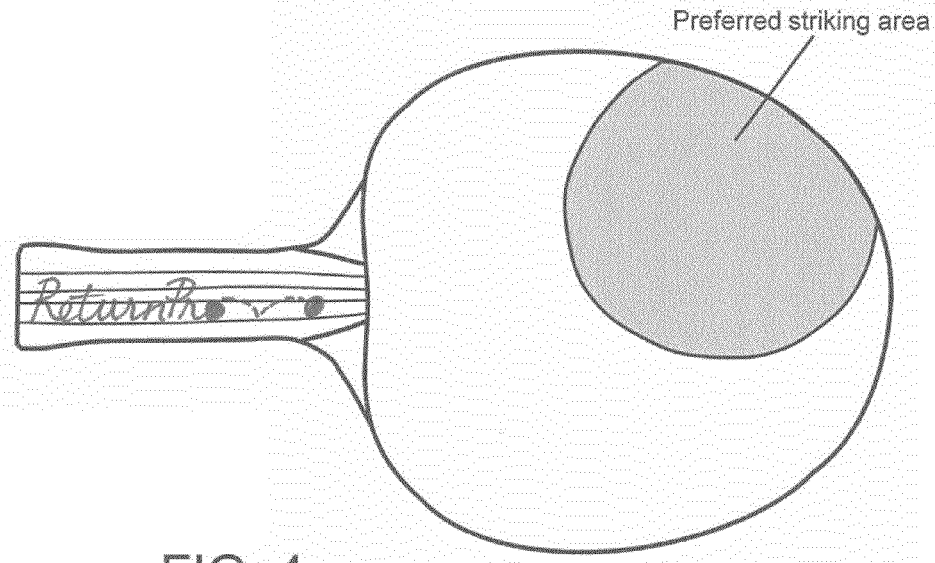
FIG. 4 shows a top view of the blade second side of the present invention.
Figure 5:
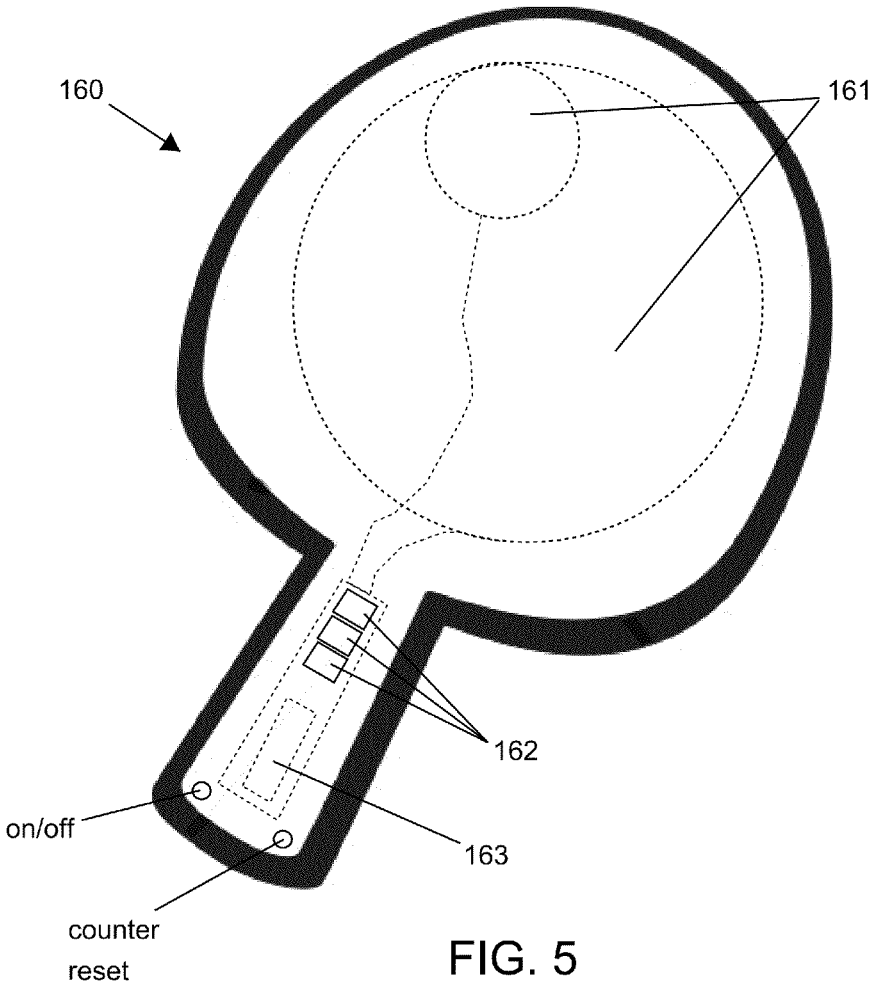
FIG. 5 shows a top view of the strike counter of the present invention.
Figure 6:
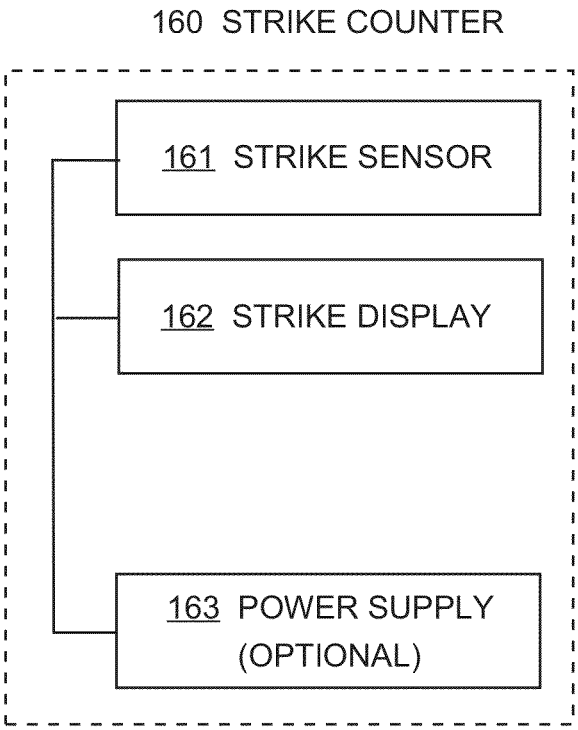
FIG. 6 shows a schematic of the strike counter of the present invention.

Following is a list of elements corresponding to a particular element referred to herein:

100 Skill improvement racket system
110 Handle
112 Handle first end
114 Handle second end
120 Blade
121 Blade first side
122 Blade first side area
123 Blade second side
124 Blade second side area
125 Blade upper edge
126 Blade lower edge
127 Blade first edge
128 Blade second edge
129 Blade midline axis
130 First color circle
131 First color circle area
140 Second color circle
141 Second color circle area
150 First quadrant
151 Second quadrant
160 Strike counter
161 Strike sensor
162 Strike display
163 Power supply
170 Blade first side color
171 Blade second side color Referring now to FIG. 1-6, the present invention features a skill improvement racket system (100) for use when playing a game of Table Tennis that highlights a preferred zone of a Table Tennis racket via a first color circle for striking a Table Tennis ball. In some embodiments, the system (100) comprises a linear handle (110) having a handle first end (112) and a handle second end (114).

In some embodiments, the system (100) comprises a planar, circular blade (120) having a blade first side (121) with a blade first side area (122) and a blade second side (123) with a blade second side area (124). In some embodiments, the blade (120) comprises a blade upper edge (125), an opposing blade lower edge (126), a blade first edge (127), an opposing blade second edge (128), and a blade midline axis (129) centrally located from the blade upper edge (125) to the blade edge (126). In some embodiments, the blade lower edge (126) is located on the handle first end (112).

In some embodiments, the system (100) comprises a first color circle (130) comprising a first color circle area (131). In some embodiments, the first color circle (130) is located on the blade first side (121) next to the blade first edge (127) and close to the blade upper edge (125). In some embodiments, the first color circle (130) overlaps the blade first edge (127). In some embodiments, the first color circle (130) intersects the blade midline axis (129). In some embodiments, at least 75% of the first color circle (130) lies in a first quadrant (150) next to the blade first edge (127) and the blade upper edge (125). In some embodiments, the first color circle (130) is a contrasting color with respect to a blade first side color (170) located on the blade first side (121).

In some embodiments, the first color circle (130) is stretched to appear more elliptical. In some embodiments, the first color circle (130) has an edge shaved off via the shape of the blade (120).

In some embodiments, the skill improvement racket system (100) is for use when playing a game of Table Tennis. In some embodiments, the system (100) highlights a preferred zone of a Table Tennis racket via a first color circle (130) for striking a Table Tennis ball.

In some embodiments, the first color circle area (131) is 25% of the blade first side area (122). In some embodiments, the first color circle area (131) is between 20-30% of the blade first side area (122). In some embodiments, the first color circle area (131) is between 15-35% of the blade first side area (122). In some embodiments, the first color circle area (131) is between 10-40% of the blade first side area (122).

In some embodiments, the first color circle (130) comprises a strike counter (160). In some embodiments, the strike counter (160) is not located in the first color circle (130). In some embodiments, the strike counter (160) covers the entirety of the first color circle (130). In some embodiments, the strike counter (160) comprises a strike sensor (161) and a strike display (162) operatively connected thereto. In some embodiments, the strike counter (160) is mechanical and comprises levers, springs and gears. In some embodiments, upon striking the Table Tennis ball, the strike sensor (161) detects the strike and the strike display (162) displays a tabulated number of strikes.

In some embodiments, the strike counter (160) is located on the blade first side (121) or the blade second side (123). In some embodiments, the strike counter (160) is located on both the blade first side (121) and the blade second side (123).

In some embodiments, the strike counter (160) is electronic. In some embodiments, a power supply (163), located in the handle (110) is operatively connected to the strike sensor (161) located in the blade (120) and the strike display (162) (located in the handle (110). In some embodiments, upon striking the Table Tennis ball, the strike sensor (161) detects the strike and the strike display (162) displays a tabulated number of strikes.

In some embodiments, the system (100) comprises a second color circle (140) comprising a second color circle area (141). In some embodiments, the second color circle (140) is located on the blade second side (123) next to the blade second edge (128) and close to a blade upper edge (125). In some embodiments, the second color circle (140) intersects a blade midline axis (129). In some embodiments, at least 75% of the second color circle (140) lies in a second quadrant (151) next to the blade second edge (128) and the blade upper edge (125). In some embodiments, the second color circle (140) is a contrasting color with respect to a blade second side color (171) located on the blade second side (123).

In some embodiments, the second color circle (140) has the same features as the first color circle (130). In some embodiments, the first color circle (130) and the second color circle (130) oppose each other on opposing sides of the blade (120). In some embodiments, the blade side has two colors or multiple colors.

In some embodiments, the second color circle (140) comprises a second strike counter (160) located therein. In some embodiments, the second strike counter (160) comprises a second strike sensor (161) and a second strike display (162) operatively connected thereto. In some embodiments, the second strike counter (160) has the same features as the first strike counter (160). In some embodiments, the strike sensor (161) is located in the handle (110). Strike counters (160), strike (impact) sensors (161), strike displays (162), and power supplies (163) are well known to those of ordinary skill in the art.

In some embodiments, the power supply (163) is a battery. In some embodiments, the power supply (163) is located in the handle (110). In some embodiments, the power supply (163) is located below the surface of the handle (110). In some embodiments, the strike display (162) is located below or flush with the surface of the handle (110). In some embodiments, a reset button and an on/off button are located on the handle (110) and operatively connected to the strike counter (160). In some embodiments, the reset button and the on/off button are located below or flush with the surface of the handle (110). In some embodiments, the strike sensor (161) or sensor wire is sandwiched between wood and padding (rubber or neoprene rubber) on one or both sides of the blade (120).

In some embodiments, the strike counter (160) tabulates each time the paddle strikes the ball or is tapped by a finger, a hand, etc.

In some embodiments, the sensory wire is sandwiched between the two woods of the handle (110) of the striking paddle.

In some embodiments, the system (100) comprises a Table Tennis table. Table Tennis tables are well known to those of ordinary skill in the art.

Table Tennis Table Return System.

In some embodiments, the system (100) comprises a Table Tennis table return system. The Table Tennis table return system has a Table Tennis table with a first edge, a second edge, two side edges, a net located between the first edge and the second edge, an L-shaped bracket comprising a first arm and second arm, a returning board, a side support bracket, and an attach means to attach the first arm to Table Tennis table.

In some embodiments, the first arm of the L-shaped bracket has a first distal end and a proximal end. The second arm has a first distal end and a second proximal end. In some embodiments, the proximal end of first arm connects with the distal end of the second arm to form the L-shaped bracket.

The returning board is located on the second arm of the L-shaped bracket and connected with the side support bracket. In some embodiments, the side support bracket is an F-shaped bracket with two flanges having the distance between the two flanges equal to the thickness of the returning board. The top edge of the returning board features chrome trim including a product logo or other manufacturer information.

Typically the returning board is located vertically (90° degrees) to the Table Tennis table surface plane. In some embodiments, the returning board is located at a variable angle with respect to the Table Tennis table surface plane. In some embodiments, the side support bracket is pivotably connected with the base support bracket.

The side support bracket has a rivet hole at the bottom end. In some embodiments, the hole is aligned with a connection hole located near the proximal end of the first arm forming a pivotable joint. In some embodiments, the side support bracket may also have an arc shaped flange with a proximal end connected near the bottom end of the bracket. In some embodiments, the flange has scales along the flange and an arc shaped slot located at the center of the flange. The first arm has a threaded bolt attached near the proximal end with the distance between the bolt and connection hole equal the distance between the slot and rivet hole. When the returning board is adjusted to desired position, the connection between the side bracket and first arm is locked by tightening a butterfly nut to the threaded bolt. In some embodiments, the butterfly nut can be replaced by a regular nut.

The Pivot angle can be adjusted in a wide range between 0 and 90 degrees, preferably between 80 and 90 degrees. In some embodiments, the pivot angle can be extended beyond 90 degrees to facilitate certain preferences of some users.

Typically the returning board is located along the first edge of the Table Tennis table. In some embodiments, the returning board can be located at a variable distance to the first edge of Table Tennis table. In some embodiments, the first arm is slidably attached along one side edge of the Table Tennis table. The first arm has an L-shape and scales on the top surface to allow the arm slide further away from the first edge of Table Tennis table precisely to a desired position. The first arm is removably attached to one side edge of Table Tennis table and tightened by one or more attach means. The attach means can be a C-clamp, F-clamp, bar clamp, spring clamp or any combination.

The Table Tennis table return system can be configured with an L-shaped bracket attached on one side edge of Table Tennis table. In some embodiments, the returning board covers part of the first edge of the Table Tennis table. Preferably, the returning board covers half the width of the first edge of the Table Tennis table.

The Table Tennis table return system can be also configured with two L-shaped brackets attached on both side edges of Table Tennis table. In some embodiments, the two L-shaped bracket are mirror-images of each other. The numbers of the L-shaped bracket on one side are applicable to both L-shaped bracket. The two side support brackets are also mirror-images of each other. The numbers of the side bracket on one side are applicable to both side brackets. The second arm of both L-shaped brackets may be connected together with or without overlap. The two L-shaped bracket may also formed together into one U-shaped bracket with only one arm in the middle to connect both side arms as a base support bracket. The second arm of the L-shaped bracket also functions as the base support bracket for the returning board. In some embodiments, the second arm is an L-shape bracket with two flanges. The flanges can be cane-shaped with the flat side jointed vertically together and vertical distance between the curved side edges is the same as the thickness of the returning board. In some embodiment, there is a base board support located inside the flange.

The returning board can be one piece or comprised of two separate pieces. The two pieces can be the same or different sizes. Preferably each piece is 30 inches wide and 24 inches tall such that the total board is 60 inches wide, which is the same width as a standard Table Tennis table. The board can be other sizes such that the board can also in used for kid-sized Table Tennis tables. The board can be made from hardwood, laminated wood, metal such as aluminum, or a metal alloy. In some embodiments, the board surface facing the Table Tennis table is covered with a rubber coating similar to the material affixed to the striking surfaces of a Table Tennis racket. The rubber coating may be of pimpled rubber, with the pimples outward, or it may be a rubber that is composed of two materials, a sponge layer, covered by a pimpled rubber, with the pimples pointed inwards or outwards. The total thickness of the returning board including the rubber coating is preferably ½ inch.

In some embodiments, the returning board has a strip on the top edge of the board. In some embodiments, the strip contains the product logo or other manufacturer's information, such as manufacturer's website, customer service hotline number, etc. The strip can be chromed or painted in a color different from the main body color of the returning board.

When the returning board comprises two pieces, each piece can be adjustable independently regarding pivot angles thus allowing different degrees between the pieces. Moreover, each piece can be located to different distance to the first edge of the Table Tennis table. Thus the player can set the system in a more personalized way according to his/her preferences.

In some embodiments, the arc shaped flange is pivotably connected to the side support bracket through a plurality of hinges. The hinges enable the returning board to be located at various swing angles. Hence, the uses can adjust the distance, pivot angle, swing angle or a combination thereof according to his/her preference and skills.

As used herein, the term "about" refers to plus or minus 10% of the referenced number.

The disclosures of the following U.S. Patents are incorporated in their entirety by reference herein: U.S. Pat. No. 6,729,982; U.S. Pat. No. 5,655,979; U.S. Pat. No. 5,566,936; U.S. Pat. No. 5,470,057; U.S. Pat. No. 4,943,056; U.S. Pat. No. 4,676,511; and U.S. Pat. No. D 260,154.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A skill improvement racket system (100) for use when playing a game of Table Tennis that highlights a preferred zone of a Table Tennis racket via a first color circle for striking a Table Tennis ball, wherein the system (100) comprises:

(a) a linear handle (110) having a handle first end (112) and a handle second end (114);

(b) a planar, circular blade (120) having a blade first side (121) with a blade first side area (122) and a blade second side (123) with a blade second side area (124), wherein the blade (120) comprises a blade upper edge (125), an opposing blade lower edge (126), a blade first edge (127), an opposing blade second edge (128), and a blade midline axis (129) centrally disposed from the blade upper edge (125) to the blade lower edge (126), wherein the blade lower edge (126) is disposed on the handle first end (112); and (c) a first color circle (130) comprising a first color circle area (131), wherein the first color circle (130) is disposed on the blade first side (121) adjacent to the blade first edge (127) and proximal to the blade upper edge (125), wherein the first color circle (130) intersects the blade midline axis (129), wherein at least 75% of the first color circle (130) lies in a first quadrant (150) adjacent to the blade first edge (127) and the blade upper edge (125), wherein the first color circle (130) is a contrasting color with respect to a blade first side color (170) disposed on the blade first side (121);

wherein the skill improvement racket system (100) is for use when playing a game of Table Tennis, wherein the system (100) highlights the preferred zone of the Table Tennis racket via the first color circle (130) for striking the Table Tennis ball.

2. The system (100) of claim 1, wherein the first color circle area (131) is 25% of the blade first side area (122).

3. The system (100) of claim 1, wherein the first color circle area (131) is between 20-30% of the blade first side area (122).

4. The system (100) of claim 1, wherein the first color circle area (131) is between 15-35% of the blade first side area (122).

5. The system (100) of claim 1, wherein the first color circle area (131) is between 10-40% of the blade first side area (122).

6. The system (100) of claim 1, wherein the first color circle (130) comprises a strike counter (160) disposed therein, wherein the strike counter (160) comprises a strike sensor (161) and a strike display (162) operatively connected thereto.

7. The system (100) of claim 6, wherein the strike counter (160) is mechanical, wherein upon striking the Table Tennis ball, the strike sensor (161) detects the strike and the strike display (162) displays a tabulated number of strikes.

8. The system (100) of claim 6, wherein the strike counter (160) is electronic, wherein a power supply (163) is operatively connected to the strike counter (160) and the strike display (162), wherein upon striking the Table Tennis ball, the strike sensor (161) detects the strike and the strike display (162) displays a tabulated number of strikes.

9. The system (100) of claim 1, comprising a second color circle (140) comprising a second color circle area (141), wherein the second color circle (140) is disposed on the blade second side (123) adjacent to the blade second edge (128) and proximal to the blade upper edge (125), wherein the second color circle (140) intersects the blade midline axis (129), wherein at least 75% of the second color circle (140) lies in a second quadrant (151) adjacent to the blade second edge (128) and the blade upper edge (125), wherein the second color circle (140) is a contrasting color with respect to a blade second side color (171) disposed on the blade second side (123).

10. The system (100) of claim 9, wherein the second color circle (140) comprises a second strike counter (160) disposed therein, wherein the second strike counter (160) comprises a second strike sensor (161) and a second strike display (162) operatively connected thereto.

11. The system (100) of claim 1, wherein the system (100) comprises a Table Tennis table.

12. The system (100) of claim 11, wherein the system (100) comprises a Table Tennis table return system.

* * * * *